US010564600B2

(12) United States Patent
Oya

(10) Patent No.: US 10,564,600 B2
(45) Date of Patent: Feb. 18, 2020

(54) IMAGE FORMING APPARATUS

(71) Applicant: CANON KABUSHIKI KAISHA, Tokyo (JP)

(72) Inventor: Yoji Oya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 15/724,461

(22) Filed: Oct. 4, 2017

(65) Prior Publication Data

US 2018/0101133 A1 Apr. 12, 2018

(30) Foreign Application Priority Data

Oct. 11, 2016 (JP) ..... 2016-199643

(51) Int. Cl.
*G03G 15/20* (2006.01)
*G03G 21/20* (2006.01)

(52) U.S. Cl.
CPC ..... *G03G 21/206* (2013.01); *G03G 15/2017* (2013.01)

(58) Field of Classification Search
CPC ..... G03G 21/206; G03G 21/20; G03G 2221/1645; G03G 15/2017
See application file for complete search history.

(56) References Cited

U.S. PATENT DOCUMENTS 9,201,395 B2 * 12/2015 Uchida ..... G03G 21/206
2003/0165345 A1 * 9/2003 Chikano ..... G03G 21/206 399/92
2007/0212104 A1 * 9/2007 Miyamoto ..... G03G 21/206 399/92
2014/0140719 A1 * 5/2014 Suzuki ..... G03G 15/0189 399/92
2014/0341607 A1 * 11/2014 Nakano ..... G03G 15/2017 399/92
2016/0077488 A1 * 3/2016 Umemoto ..... G03G 21/206 399/93

FOREIGN PATENT DOCUMENTS

JP 2003-316237 A 11/2003
JP 2008-250284 A 10/2008
JP 2012-068488 A 4/2012
JP 2013-120303 A 6/2013
JP 2015-028563 A 2/2015

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes an image forming portion configured to form a toner image on a recording material, a fixing portion configured to fix the toner image on the recording material, a stacking portion configured to stack the recording material on which the toner image is fixed, an air passageway provided between the image forming portion and the fixing portion and between the image forming portion and the stacking portion, and an air blowing portion configured to blow air to the air passageway from outside of the image forming apparatus. The air passageway is configured so that the air blown from the outside by the blowing portion passes below the stacking portion and, thereafter, is folded back below the fixing portion and, then, passes again below the stacking portion.

10 Claims, 10 Drawing Sheets

IMAGE FORMING APPARATUS

This application claims the benefit of Japanese Patent Application No. 2016-199643 filed on Oct. 11, 2016, which is hereby incorporated by reference herein in its entirety.

FIELD OF THE INVENTION AND RELATED ART

The present invention relates to an image forming apparatus, such as an image forming apparatus such as a copying machine or a printer.

In the image forming apparatus of an electrophotographic type, as a liability generated due to temperature rise in an apparatus main assembly, there is a change in physical property of a developer with a temperature rise of the developer. By the change in physical property of the developer, the changed physical property constitutes an obstacle to an image forming process, so that a problem such that an image defect is caused, and the developer adheres to image forming process portion and a transfer portion generates. For that reason, there is also an image forming apparatus having a constitution such that in a case when temperatures of the image forming process portion and the transfer portion exceed proper values during continuous operation, the operation is stopped, and the image forming apparatus is cooled. In order to continuously output a good-quality image, there is a need to employ a constitution for suppressing a temperature rise of the image forming process portion and the transfer portion.

Japanese Laid-Open Patent Application (JP-A) 2013-120303 employs a constitution for cooling a "metal plate facing a transfer belt of a transfer portion in a non-contact manner", in which the transfer belt is indirectly cooled by cooling the metal plate facing the transfer belt, so that suppression of the temperature rise at periphery of a photosensitive member is realized. In JP-A 2015-028563, a cooling chamber is defined immediately on an intermediary transfer belt, so that cooling of the intermediary transfer belt is realized by passing the air through the cooling chamber.

In JP-A 2008-250284, a ventilating duct is provided in a space sandwiched between an image forming unit and a fixing unit. As a result, cooling of an image forming portion is realized.

However, in the above-described constitution, in some cases, a blockage of heat conducted from a recording material discharged on a discharge tray or from a fixing portion is insufficient and toner scattering by cooling air generates, so that these constitutions have room for improvement.

SUMMARY OF THE INVENTION

The present invention has solved the above-described problem, and a principal object of the present invention is to provide an image forming apparatus capable of suppressing a temperature rise of an image forming portion due to conduction of heat of a fixing portion and residual heat of a recording material on a stacking portion without generating an image defect due to deposition of dust and scattering of a developer.

According to one aspect, the present invention provides an image forming apparatus comprising an image forming portion configured to form a toner image on a recording material, a fixing portion configured to fix the toner image on the recording material, a stacking portion configured to stack the recording material on which the toner image is fixed, an air passageway provided between the image forming portion and the fixing portion and between the image forming portion and the stacking portion, and an air blowing portion configured to blow air to the air passageway, wherein the air passageway is configured so that the air blown by the air blowing portion passes below the stacking portion and, thereafter, is folded back below the fixing portion and then passes again below the stacking portion.

Further features of the present invention will become apparent from the following description of exemplary embodiments with reference to the attached drawings.

Figure 2:
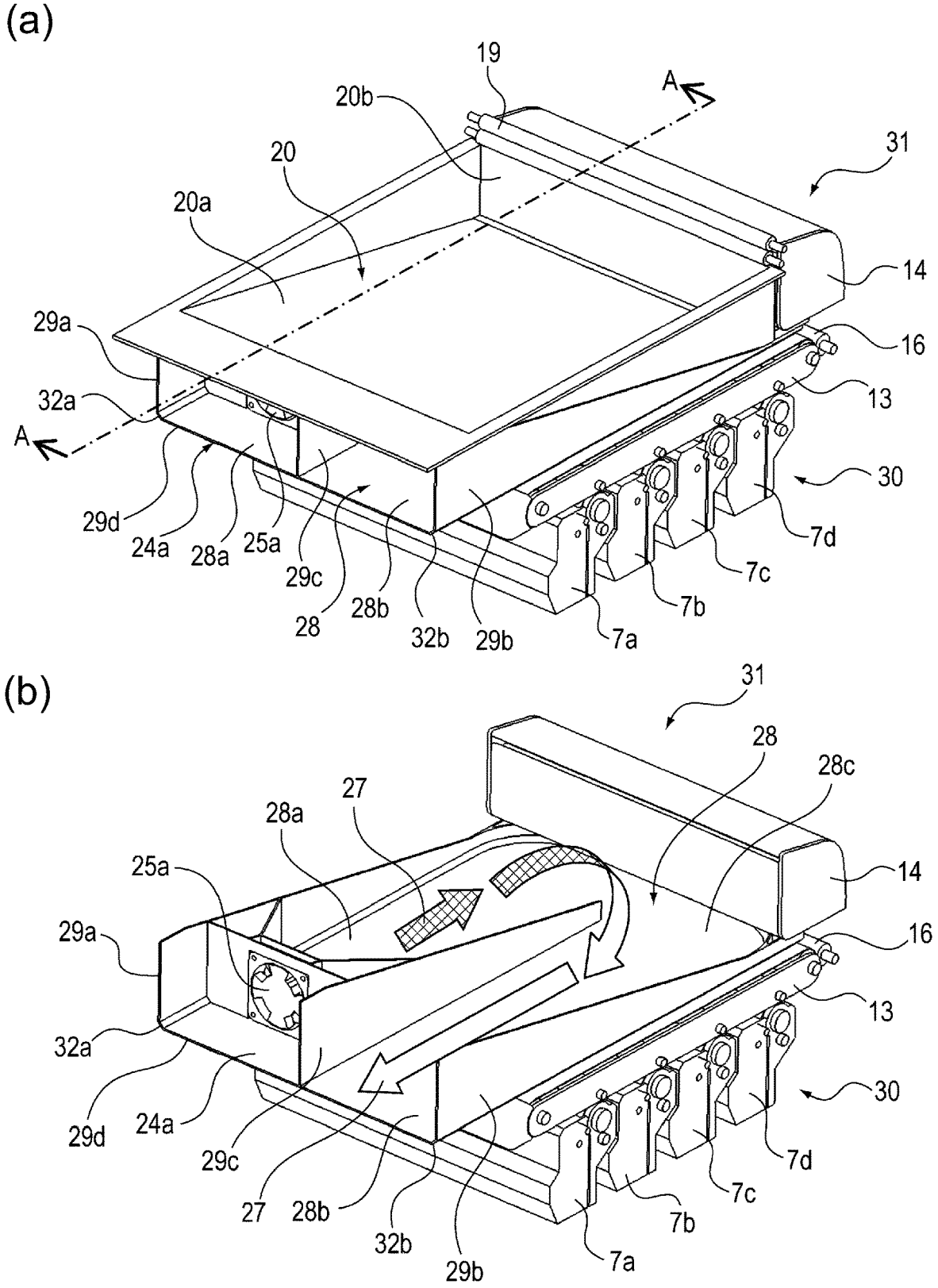

Part (a) of FIG. 2 is a perspective view showing a structure of a duct in a First Embodiment, and part (b) of FIG. 2 is a perspective view showing a flow of air passing through an inside of the duct in First Embodiment.

Figure 3:
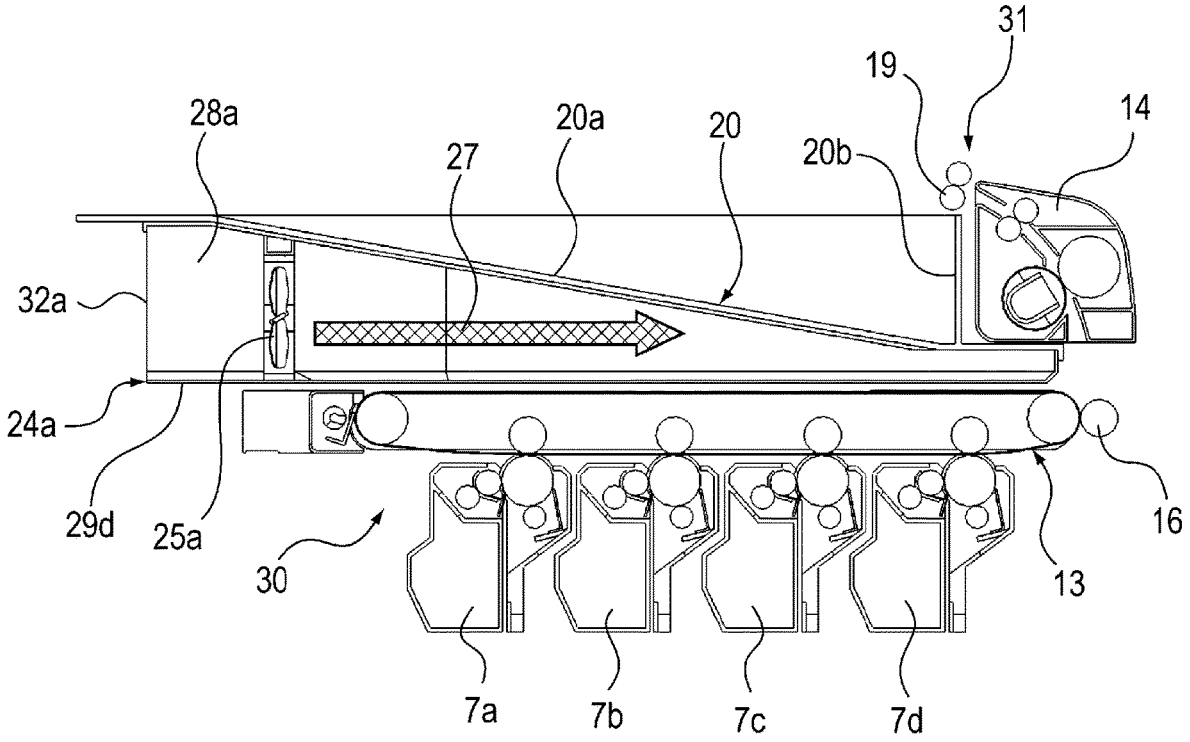

FIG. 3 is a sectional view along line A-A in part (a) of FIG. 2.

Figure 4:
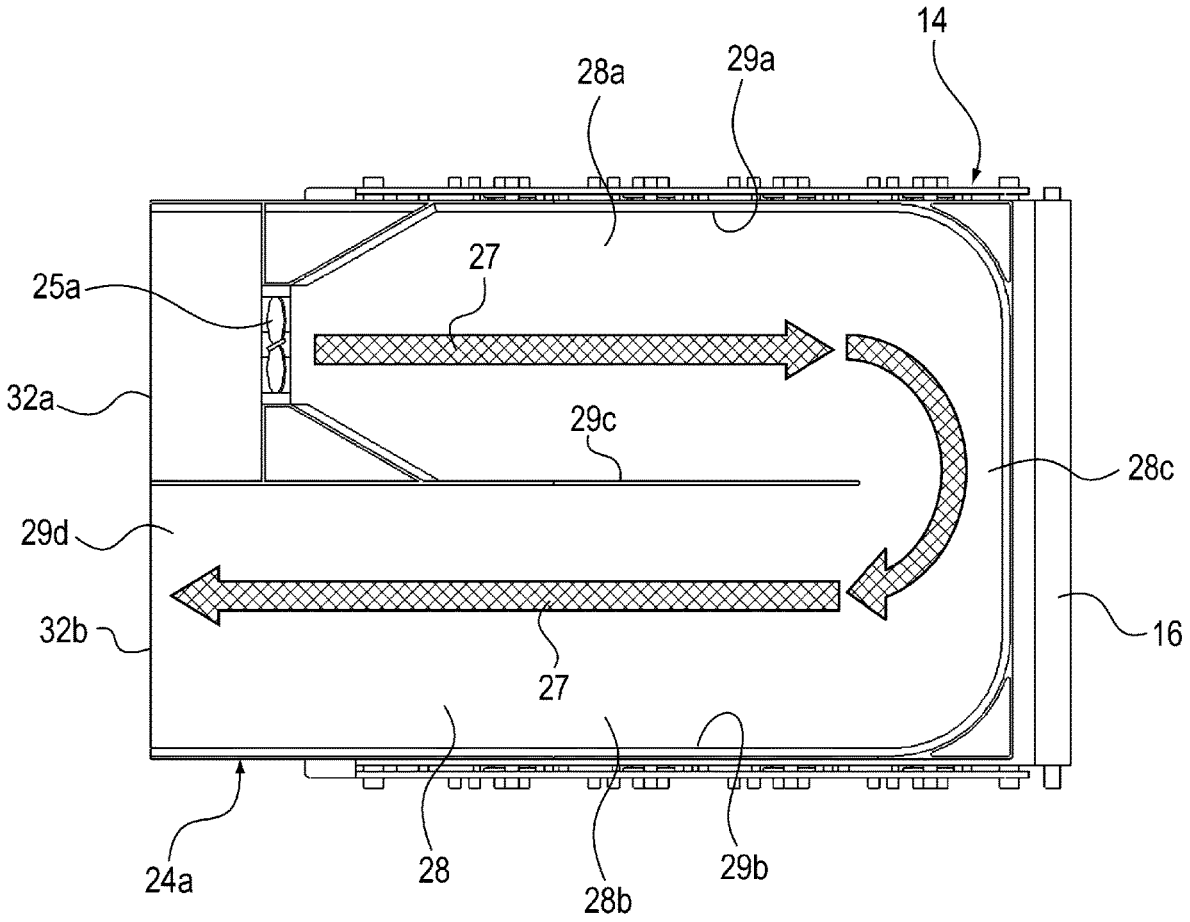

FIG. 4 is a plan view showing the flow of the air passing through the inside of the duct in First Embodiment.

Figure 5:
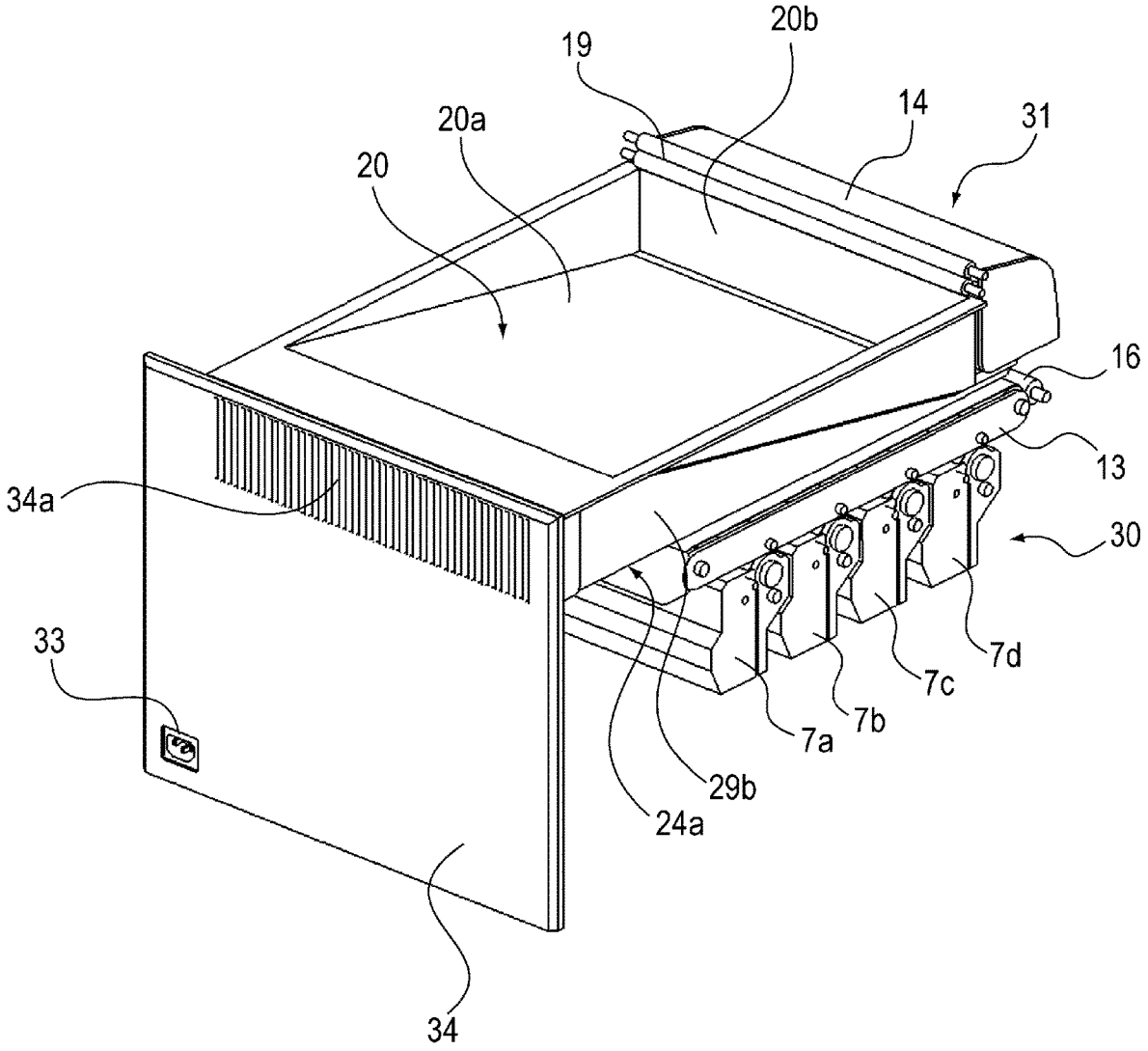

FIG. 5 is a perspective view showing an example of a structure in which a side plate provided on the same flat plane as an opening of the duct in the First Embodiment is provided with an inlet of a power (voltage) source.

Figure 6:
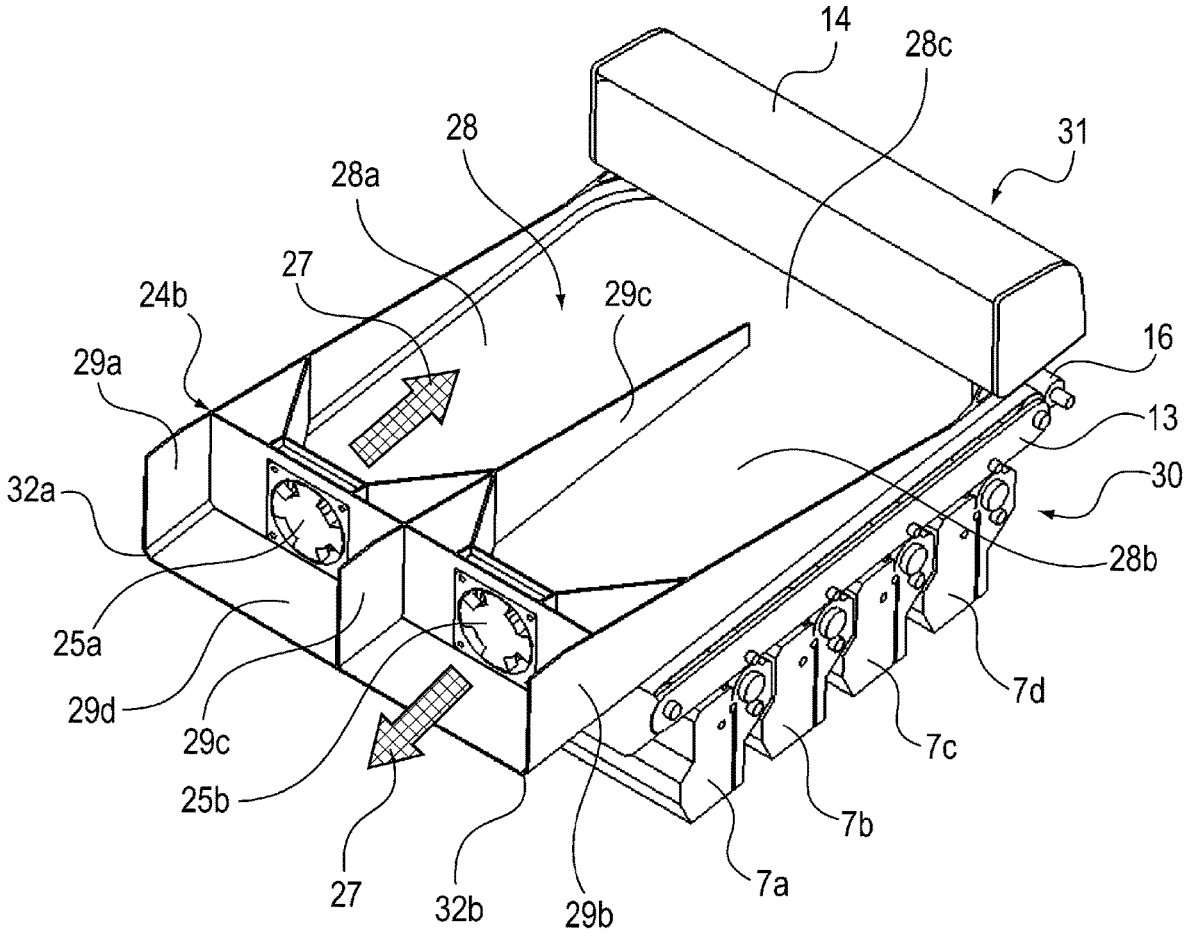

FIG. 6 is a perspective view showing a flow of air passing through an inside of a duct in a Second Embodiment.

Figure 7:
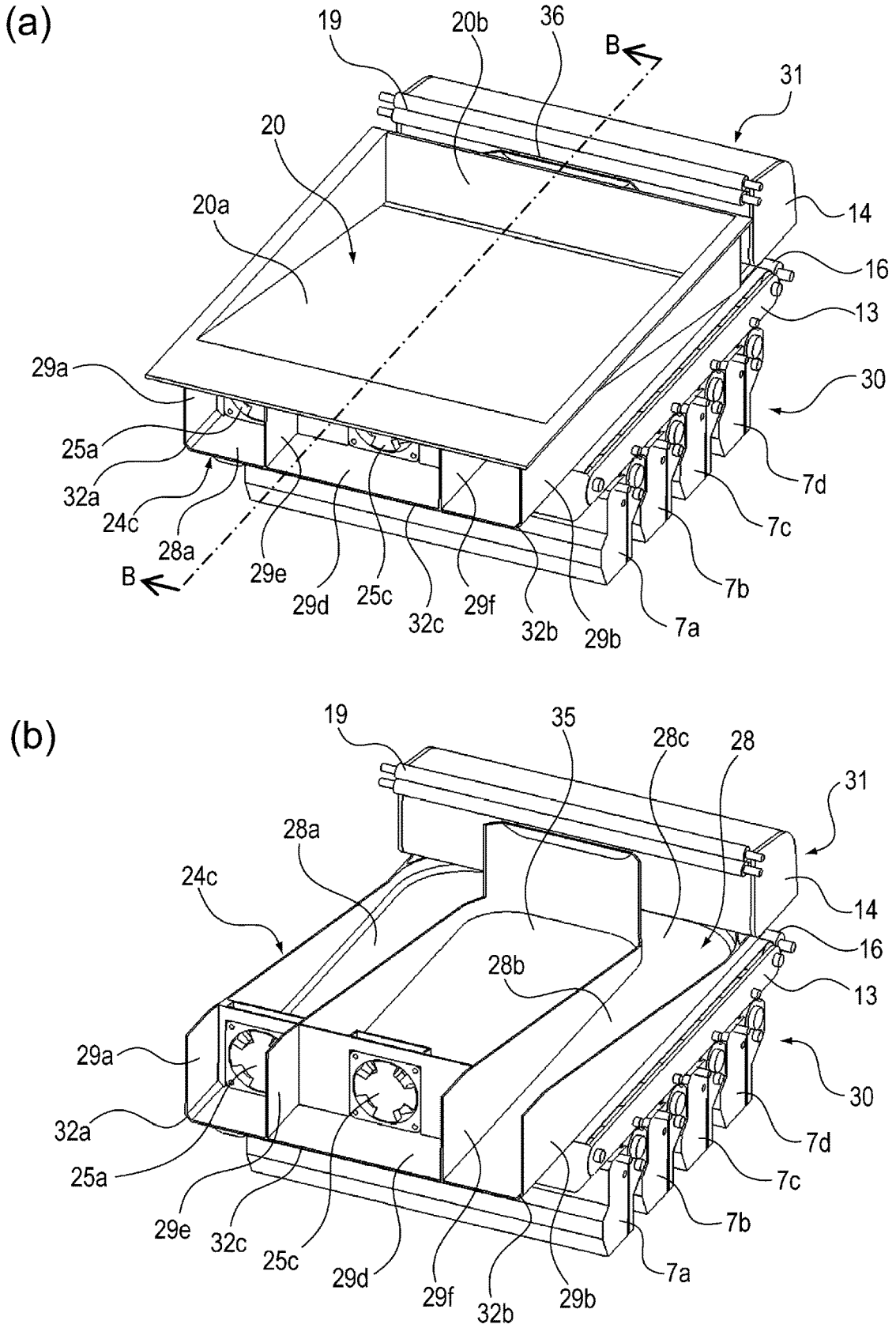

Part (a) of FIG. 7 is a perspective view showing a structure of a duct in a Third Embodiment, and part (b) of FIG. 7 is a perspective view showing a structure in the duct in the Third Embodiment.

Figure 8:
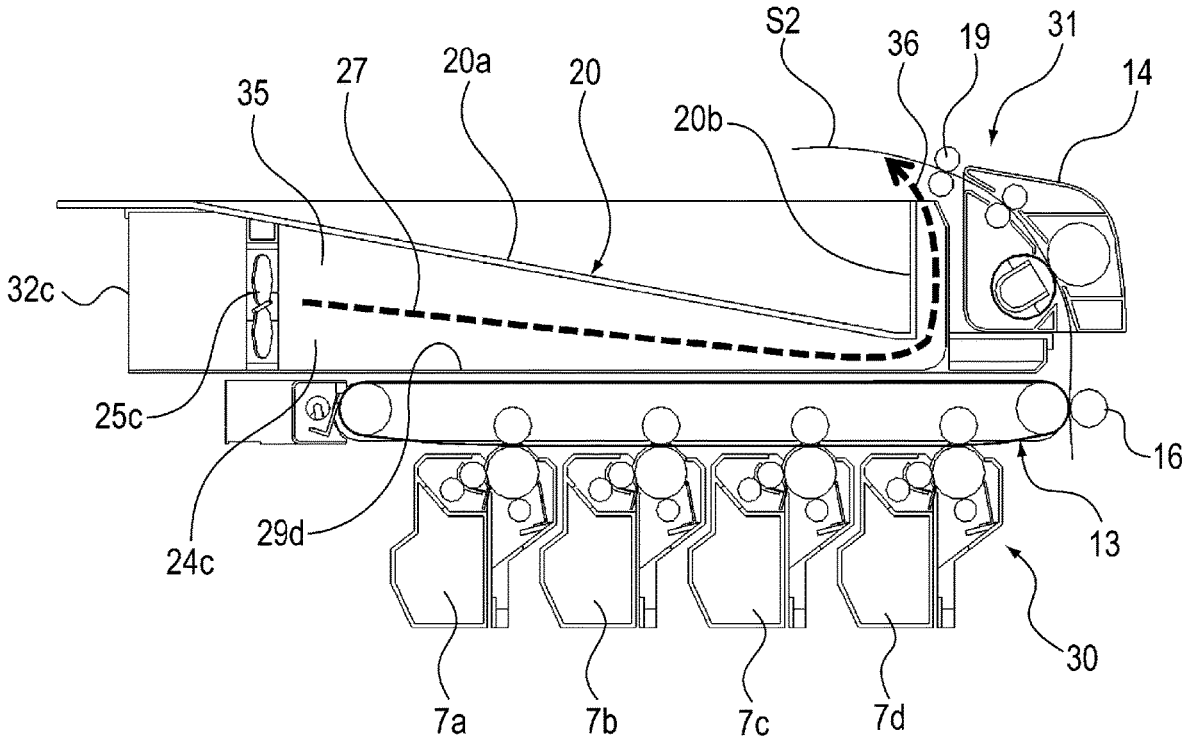

FIG. 8 is a sectional view along line B-B in part (a) of FIG. 7.

Figure 9:
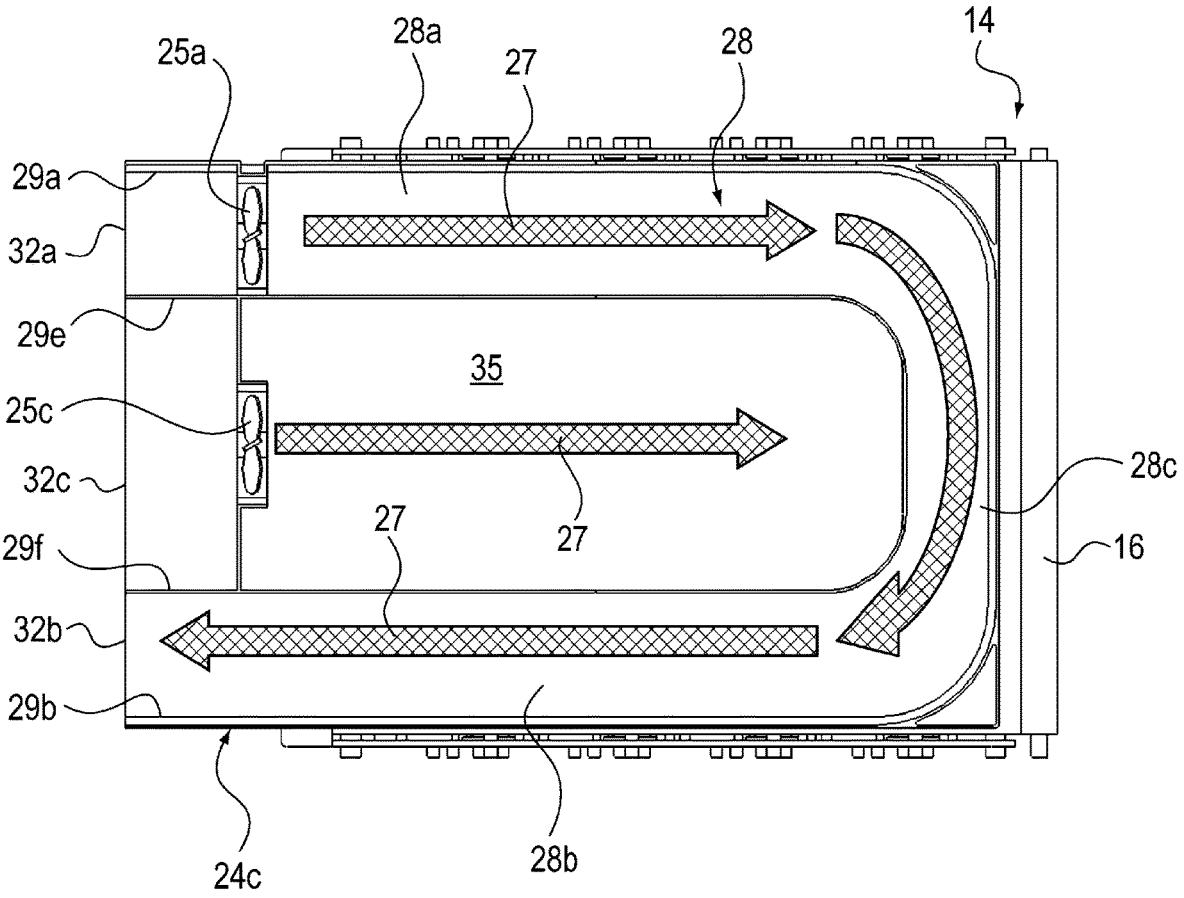

FIG. 9 is a plan view showing a flow of air passing through an inside of the duct in the Third Embodiment.

Figure 10:
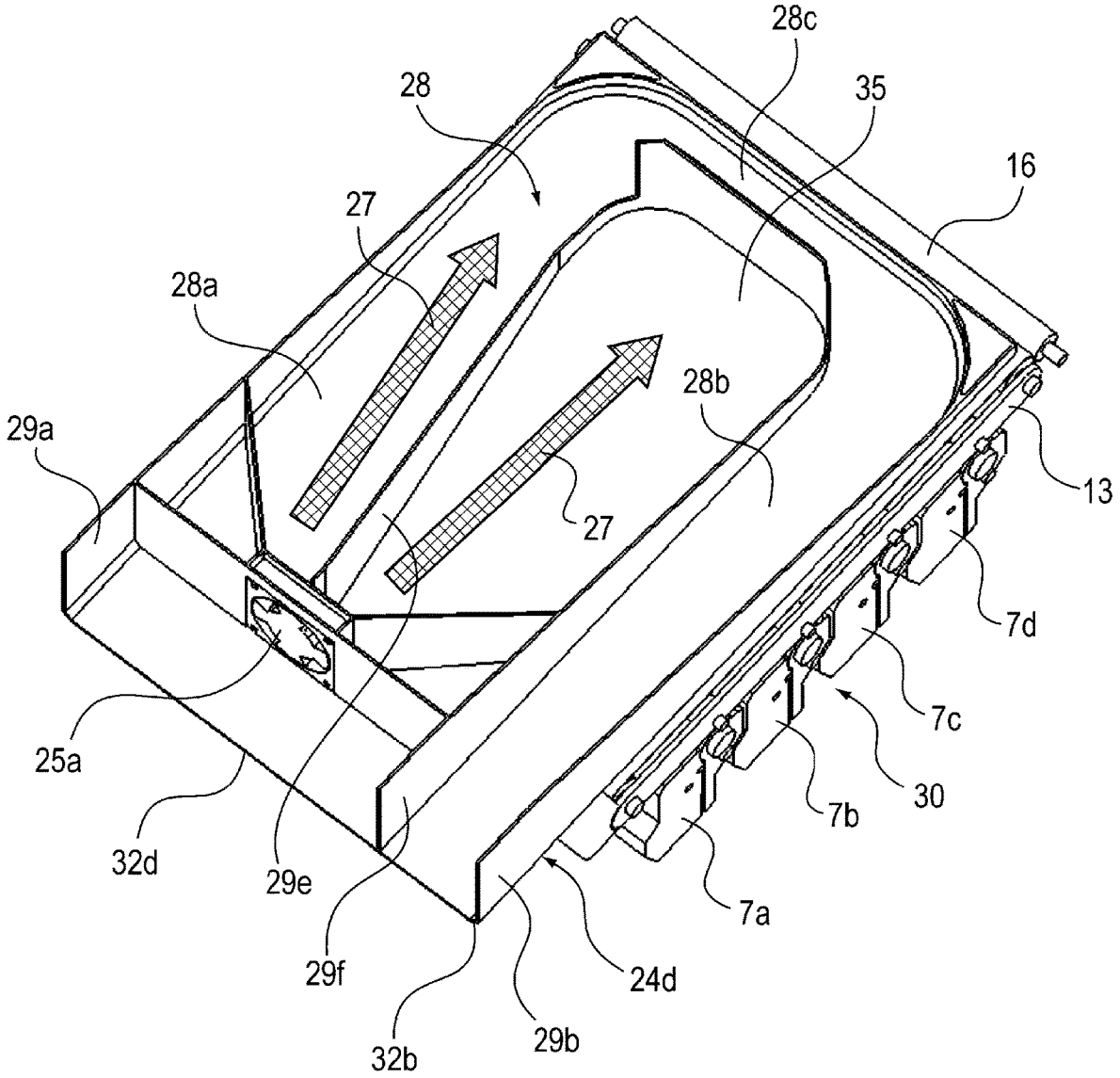

FIG. 10 is a perspective view showing a flow of air passing through an inside of a fourth Embodiment.

DESCRIPTION OF EMBODIMENTS

Embodiments of an image forming apparatus according to the present invention will be specifically described with reference to the drawings.

First Embodiment

Figure 1:
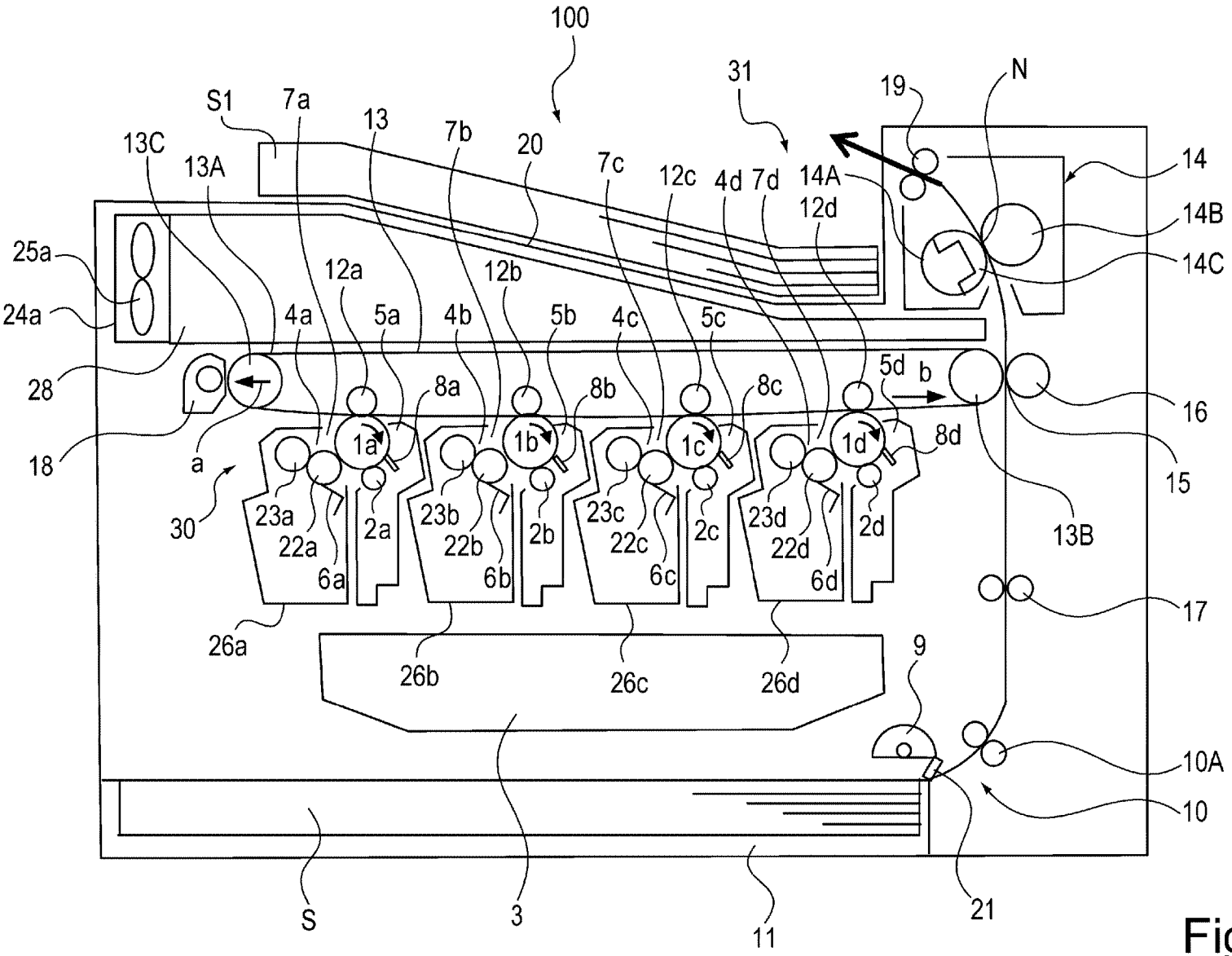
FIG. 1 is a sectional view showing a structure of an image forming apparatus according to the present invention.

First, a constitution of a First Embodiment of an image forming apparatus according to the present invention will be described with reference to FIGS. 1 to 5. FIG. 1 is a sectional view showing a structure of the image forming apparatus according to the present invention. Part (a) of FIG. 2 is a perspective view showing a structure of a duct in the First Embodiment. Part (b) of FIG. 2 is a perspective view showing a flow of air 27 passing through an inside of the duct in the First Embodiment. FIG. 3 is a sectional view along line A-A in part (a) of FIG. 2. FIG. 4 is a plan view showing the flow of the air 27 passing through the inside of the duct in the First Embodiment. FIG. 5 is a perspective view showing an example of a structure in which a side plate provided on the same flat plane as an opening of the duct in the First Embodiment is provided with an inlet of a power source.

<Image Forming Apparatus>

An image forming apparatus 100 includes photosensitive drums 1*a* to 1*d*, which are image bearing members of colors of yellow Y, magenta M, cyan C, and black B. The respective photosensitive drums 1*a*-1*d* rotate in the clockwise direction indicated in FIG. 1. The image forming apparatus 100 includes an image forming process portion for forming toner images by acting on the surfaces of the photosensitive drums 1*a* to 1*d* rotating in the clockwise direction in FIG. 1. Incidentally, for convenience of explanation, a description will be made in some cases by simply using the photosensitive drum 1 as a representative of the photosensitive drums 1*a* to 1*d*. This is true for the image forming process portion.

At a periphery of each photosensitive drum 1, a charging roller 2, which is a charging portion, is provided. Further, an exposure device 5, which is an image exposure portion, is provided. Further, a developing unit 4, which is a developing portion, is provided. In addition, a cleaning blade 8, which is a cleaning portion, is provided.

An intermediary transfer unit 13, which is a transfer portion for the toner images, formed on the surfaces of the respective photosensitive drums 1 (image baring members), onto a recording material S, is provided opposed to the surfaces of the respective photosensitive drums 1. The intermediary transfer unit 13 includes an intermediary transfer belt 13A stretched rotatably in the counterclockwise direction in FIG. 1 by a driving roller 13B and a tension roller 13C. To the tension roller 13C, tension is applied in an arrow a direction by an unshown urging portion.

In an inner peripheral surface side of the intermediary transfer belt 13A, primary transfer rollers 12, which are a primary transfer portion, are provided opposed to the surfaces of the photosensitive drums 1, respectively. To each of the primary transfer rollers 12, a primary transfer bias is applied from an unshown primary transfer bias voltage source.

<Image Forming Operation>

The surface of each of the photosensitive drums 1 rotating in the clockwise direction is electrically charged uniformly by the charging roller 2. The uniformly charged surface of the photosensitive drum 1 is irradiated with light, depending on image information, by the exposure device 3. In developing containers 26 of the developing units 4, toners of yellow Y, magenta M, cyan C, and black B are accommodated. To an electrostatic latent image formed on the surface of each of the photosensitive drums 1, the toner of the associated color is supplied by the associated developing roller 22, which is a developer carrying member, so that the toner (developer) is deposited on the electrostatic latent image and, thus, the electrostatic latent image is developed and visualized into a toner image.

The toner images formed on the surfaces of the respective photosensitive drums 1 are successively primary-transferred superposedly onto an outer peripheral surface of the intermediary transfer belt 13A rotating in the counterclockwise direction in FIG. 1, under application of the primary transfer bias from the unshown primary transfer bias voltage source to the primary transfer rollers 12. Transfer residual toners remaining on the photosensitive drums 1 are scraped off and removed by cleaning blades 8.

<Image Forming Process Portion>

In this embodiment, a process cartridge 7 which is an image forming process portion, is constituted by integrally assembling the photosensitive drum 1, the charging roller 2, the developing unit 4, and the cleaning blade 8 into a unit (cartridge). The process cartridge 7 is detachably mountable to a main assembly of the image forming apparatus 100. The image forming process portion forms the toner image on the surface of the photosensitive drum 1 (image bearing member). In this embodiment, an image forming portion 30 is constituted by the image forming process portion and the intermediary transfer unit 13 (transfer portion).

The process cartridge 7 is constituted by integrally providing the photosensitive drum 1 and at least one of the image forming process portion (charging portion, developing portion, cleaning portion, and the like) actable on the surface of the photosensitive drum 1. The process cartridge 7 includes the developing unit 4 and a cleaner unit 5.

The developing unit 4 includes a developing roller 22 for depositing the developer on the surface of the photosensitive drum 1 and an application roller 23 for applying the developer onto the surface of the developing roller 22. The developing unit 4 further includes a developing blade 6 for regulating a thickness of a layer of the developer carried on the surface of the developing roller 22 and includes the developing container 26. On the other hand, the cleaner unit 5 includes the photosensitive drum 1, the charging roller 2, and the cleaning blade 8.

The photosensitive drum 1 is constituted by applying an organic photoconductor (OPC, organic optical semiconductor) layer onto an outer peripheral surface of an aluminum cylinder. At end portions of the photosensitive drum 1 with respect to an axial direction, flanges are provided and the photosensitive drum 1 is rotatably supported by the flanges. To one of the end portions of the photosensitive drum 1 with respect to the axial direction, a driving force is transmitted from an unshown driving motor. As a result, the photosensitive drum 1 is rotated in the clockwise direction in FIG. 1.

The charging roller 2, which is the charging portion, is constituted by an electroconductive roller formed in a roller shape. The charging roller 2 is contacted to the surface of the photosensitive drum 1, and a charging bias voltage is applied to the charging roller 2 from an unshown charging bias voltage source. As a result, the surface of the photosensitive drum 1 is electrically charged uniformly. The exposure device 3 is disposed below the process cartridges 7. The surface of each of the photosensitive drums 1 is irradiated with light on the basis of an image signal.

In each of the developing units 4, the developing container 26, which is constituted by a frame for accommodating the developer (toner) of the associated color, is provided. Further, in the developing container 26, the developing roller 22 is provided. The developing roller 22 is disposed opposed to the surface of the associated photosensitive drum 1 and is rotationally driven by an unshown motor, which is a driving source. A developing bias voltage is applied from an unshown developing bias voltage source to the developing roller 22. As a result, the developer (toner) of the associated color carried on the surface of the developing roller 22 is supplied to the electrostatic latent image formed on the surface of the photosensitive drum 1, so that the electrostatic latent image is developed into the toner image.

The surface of the photosensitive drum 1 is charged to a predetermined negative potential by the charging roller 2, which is the charging portion, and thereafter, the electrostatic latent image is formed on the surface of the photosensitive drum 1 by the exposure device 3, which is the image exposure portion. Thereafter, a negative(-polarity) developer (toner) is deposited by the developing unit 4 on the electrostatic latent image formed on the surface of the photosensitive drum 1, so that the electrostatic latent image is developed and visualized as a developer image (toner image).

The intermediary transfer belt 13A is rotated in an arrow b direction in FIG. 1. From an unshown primary transfer bias voltage source, a positive(-polarity) primary transfer bias is applied to the primary transfer rollers 12. Then, the developer images (toner images) are successively primary-transferred from the photosensitive drums 1*a* to 1*d* onto the outer peripheral surface of the intermediary transfer belt 13A. In a state in which the four color toner images are superposed on the outer peripheral surface of the intermediary transfer belt 13A, the toner images are fed to a secondary transfer nip 15 where a secondary transfer roller 16, which is a secondary transfer portion, opposes the driving roller 13B.

A feeding device 10 includes a feeding roller 9 for feeding a recording material S from a feeding cassette 11 accommodating the recording material S. The feeding device 10 further includes a separation pad 21 for separating the recording material S fed by the feeding roller 9. The feeding device 10 further includes a conveying roller pair 10A for nipping and conveying the recording material S separated and fed one by one by a cooperation between the feeding roller 9 and the separation pad 21.

The feeding cassette 11 is detachably mountable to the main assembly of the image forming apparatus 100. A user pulls out the feeding cassette 11 from the main assembly of the image forming apparatus 100 and sets the recording material S in the cassette 11, and then inserts the feeding cassette 11 into the main assembly of the image forming apparatus 100, so that a supplying operation of the recording material S is completed.

The recording material S accommodated in the feeding cassette 11 is fed by the feeding roller 9 in a press-contact state, and is separated and fed one by one by the cooperation between the feeding roller 9 and the separation pad 21. Thereafter, a free end of the recording material S nipped and fed by the conveying roller pair 10A is abutted against a nip of a registration roller pair 17 once stopped. As a result, oblique movement of the recording material S is corrected by stiffness of the recording material S. Thereafter, the registration roller pair 17 is rotationally driven at predetermined timing, so that the recording material S is fed to a secondary transfer nip 15.

At the secondary transfer nip 15, a positive secondary transfer bias is applied from an unshown secondary transfer bias voltage source to a secondary transfer roller 16. As a result, the developer images (toner images) carried on the outer peripheral surface of the intermediary transfer belt 13A are secondary-transferred onto the recording material S fed to the secondary transfer nip 15. At this time, the toner images secondary-transferred onto the recording material S are un-fixed toner images containing developers. Residual toner remaining on the outer peripheral surface of the intermediary transfer belt 13A after the secondary transfer is removed by a cleaner 18, which is a cleaning portion.

<Fixing Device>

A fixing device 14, which is a fixing portion for fixing the toner image formed on the recording material S by the image forming portion 30, heat-fixes the unfixed toner image on the recording material S under application of heat and pressure to the unfixed toner image secondary transferred on the recording material S. The fixing device 14 includes an endless fixing belt 14A, an elastic pressing roller 14B, and a guiding member 14C to which a heat generating portion such as a heater is bonded. The pressing roller 14B sandwiches the fixing belt 14A between itself and the guiding member 14C, so that a fixing nip N with a predetermined width is formed by causing the fixing belt 14A to press-contact the guiding member 14C with a predetermined pressing force.

The pressing roller 14B is rotationally driven in the clockwise direction in FIG. 1 by an unshown motor, which is a driving source. The fixing belt 14A is rotated in the counterclockwise direction in FIG. 1 by the pressing roller 14B by a frictional force between the fixing belt 14A and the pressing roller 14B. At this time, the fixing belt 14A is heated by the heater provided in the guiding member 14C.

In a state in which the fixing belt 14A is raised in temperature to a predetermined temperature at the fixing nip N and is temperature-controlled, the recording material S, on which the unfixed toner image is formed, is introduced between the outer peripheral surface of the fixing belt 14A and the pressing roller 14B at the fixing nip N. When the recording material S is introduced so that an image surface thereof opposes the outer peripheral surface of the fixing belt 14A, at the fixing nip N, the recording material S is nipped and conveyed at the image surface thereof through the fixing nip N while intimately contacting the outer peripheral surface of the fixing belt 14A.

In a process in which the recording material S is nipped and fed together with the fixing belt 14A through the fixing nip N, the unfixed toner image on the recording material S is heated by heat of the heater provided in an inner peripheral surface side of the fixing belt 14A, and is heat-melted and, thus, is thermally fixed. The recording material S on which the toner image is thermally fixed, is nipped and fed by a discharging roller pair 19 and is discharged on a discharge tray 20.

In this embodiment, the image forming apparatus includes the fixing device 14 (fixing portion) and the discharge tray 20, which is a stacking portion for stacking the recording material S, on which the toner image is fixed by the fixing device 14.

<Suppress of Temperature Rise>

Next, a constitution for suppressing a temperature rise of the image forming portion in this embodiment will be described. As shown in FIG. 2, the image forming apparatus of this embodiment insulates between the discharge tray 20 and the image forming portion 30, and between the fixing portion 14 and a discharge portion by a U-shaped fold-back air passageway 28 in an air layer.

In this embodiment, a suction fan 25*a*, which is an air blowing portion by which air 27 is taken from an outside of the main assembly of the image forming apparatus 100 and by which the air 27 is blown (sent) to an inside of the main assembly of the image forming apparatus 100, is provided. The image forming apparatus 100 further includes a duct 24*a* for guiding the air 27 sent from the suction fan 25*a*.

The duct 24*a* shown in part (b) of FIG. 2 includes a bottom plate 29*a* provided along a discharge direction (leftward direction in FIG. 1) of the recording material S. The duct 24*a* further includes a pair of side plates 29*a* and 29*b*, which are perpendicular to the bottom plate 29*d* and which stand from the bottom plate 29*d*, and includes a partition wall 29*c* provided at a substantially central portion between the pair o side plates 29*a* and 29*b*. The duct 24*a* having an E-shape in cross section is constituted by the bottom plate 29*d*, the pair of side plates 29*a* and 29*b*, and the partition wall 29*c*. The duct 24*a* is set so that a height thereof gradually lowers toward the fixing device 14 depending on an inclination angle of the discharge tray 20.

When the suction fan 25*a* mounted in the neighborhood of an air suction surface 32*a* of the duct 24*a* rotates, the air 27 flows from the outside of the main assembly of the image forming apparatus 100 into the duct 24*a*. The air passageway 28 is an air passageway in the duct 24*a*.

In an up-down direction in FIGS. 1 and 3, the U-shaped fold-back air passageway 28 is formed between the image forming portion 30 constituted by the respective process cartridges 7 and the intermediary transfer unit 13, and the discharge portion 31 constituted by the fixing device 14 and the discharge tray 20.

As shown in part (b) of FIG. 2, and in FIGS. 3 and 4, in the air passageway 28, the air 27 taken in the main assembly of the image forming apparatus 100 by rotation of the suction fan 25*a* once passes through a portion below the discharge tray 20. Thereafter, the air 27 is folded back below the fixing device 14 in a U-turn manner. Then, the air passes again through the portion below the discharge tray 20. Thus, the air passageway 28 is constituted in a U-shape.

The air passageway 28 formed in the duct 24*a* acts as an air heat-insulating layer between the image forming portion 30 constituted by the process cartridges 7 and the intermediary transfer unit 13, and the discharge portion 31 constituted by the fixing device 14 and the discharge tray 20. As a result, heat generated by the fixing device 14 and residual heat of the recording material S1 stacked on the discharge tray 20 shown in FIG. 1 are not readily conducted to the image forming portion 30 constituted by the process cartridges 7 and the intermediary transfer unit 7. As a result, the temperature rise of the image forming portion 30 is suppressed.

Further, the air passageway 28 formed in the duct 24*a* is constituted as a closed space by the duct 24*a* and the discharge tray 20. As a result, deposition of dust (dirt) and scattering of the developer on the image forming portion 30 constituted by the process cartridges 7 and the intermediary transfer unit 13 can be prevented. Further, there is no liability that leaked air blows against the fixing member of the fixing device 14 and causes a lowering in temperature of the fixing member and, thus, causes improper fixing or the like.

As shown in part (b) of FIG. 2 and in FIG. 4, the U-shaped fold-back air passageway 28 has an area larger than a size (area) of the intermediary transfer belt 13A and the discharge tray 20. For this reason, by a single air passageway, an air heat-insulating layer with a wide range can be formed between the image forming portion 30 and the discharge portion 31.

Further, as shown in FIG. 4, the U-shaped fold-back air passageway 28 includes an air suction surface 32*a* consisting of an opening surface of the duct 24*a* through which the air 27 is sucked. Further, the U-shaped fold-back air passageway 28 includes an air discharge surface 32*b* consisting of an opening surface of the duct 24*a* through which the air 27 is discharged. Further, the air suction surface 32*a* and the air discharge surface 32*b* are provided on the same plane 34 (FIG. 5).

When a suction and discharge efficiency of the suction fan 25*a* is taken into consideration, there is a need to install the image forming apparatus 100 in a position spaced from a wall of a building. In this embodiment, the air suction surface 32*a* and the air discharge surface 32*b* are provided on the same plane 34, and, therefore, the number of surfaces required to worry about a distance from the wall of the building is only one. For that reason, a constraint of an installation place of the image forming apparatus 100 can be reduced.

Further, as regards the installation of the image forming apparatus 100, there is a limit of a side surface position where an inlet 33 (such as a plug or a receptacle, which is provided at a free end of a power (source) cord or cable) of a power (voltage) source. For this reason, as shown in FIG. 5, the inlet 33 of the power source is provided in a side plate 34 on which the air suction surface 32*a* and the air discharge surface 32*b* are provided, so that the surface limited, when the image forming apparatus 100 is installed, can be restricted. The side plate 34 shown in FIG. 5 includes a ventilation opening 34*a* consisting of through holes communicating with the air suction surface 32*a* and the air discharge surface 32*b*, which are consisting of the openings of the duct 24*a*.

In this embodiment, the air 27 sent from the suction fan 25*a* passes through the portion below the discharge tray 20 through the air passageway 28 in the duct 24*a*. Thereafter, the air 27 is U-turned below the fixing device 14 and then passes through the portion below the discharge tray 20. The duct 24*a* in this embodiment forms such a U-shaped fold-back air passageway 28. As a result, at peripheries of the fixing device 14 and the image forming portion 30 constituted by the process cartridges 7 and the intermediary transfer unit 13, the air 27 is prevented from leaking out, so that air flow is not disturbed. For this reason, there is no liability that improper fixing due to deposition of dust, scattering of the developer, and cooling of the fixing device 14 is not caused.

Further, the duct 24*a* is configured to form the U-shaped fold-back air passageway 28, so that the air heat-insulating layer covering a large area can be formed by a single air passageway 28.

Second Embodiment

A constitution of a Second Embodiment of the image forming apparatus according to the present invention will be described with reference to FIG. 6. FIG. 6 is a perspective view showing a flow of the air 27 passing through a duct 24*b* in the Second Embodiment. Incidentally, constituent elements similar to those in the First Embodiment are represented by the same reference numerals or symbols, or represented by the same member names, even when the reference numerals or symbols are different, and will be omitted from this description.

In the First Embodiment described above, an example, in which the single suction fan 25*a* is provided to the duct 24*a*, was described. In this embodiment, not only the suction fan 25*a*, but also, a suction fan 25*b* are provided. Each of the suction fans 25*a* and 25*b* is rotated, so that the air 27 is caused to pass through the U-shaped fold-back air passageway 28 in the duct 24*b*.

As a result, a passing efficiency of the air 27 in the U-shaped fold-back air passageway 28 increases, so that an effect of the U-shaped fold-back air passageway 28 as the air heat-insulating layer can be enhanced. Incidentally, constituent elements of the duct 24*a* in this embodiment are substantially similar to those of the duct 24*a* in the First Embodiment, and, therefore, will be omitted from a redundant description. Other constituent elements are similar to those in the First Embodiment, so that a similar effect can be obtained.

Third Embodiment

Next, a constitution of a Third Embodiment of an image forming apparatus according to the present invention will be described with reference to FIGS. 7 to 9. Part (a) of FIG. 7 is a perspective view showing a structure of a duct 24*c* in the Third Embodiment. Part (b) of FIG. 7 is a perspective view showing a structure of an inside of the duct 24*c* in the Third Embodiment. FIG. 8 is a sectional view along line B-B in part (a) of FIG. 7. FIG. 9 is a plan view showing the flow of the air 27 passing through the inside of the duct 24*c* in the Third Embodiment. Incidentally, constituent elements similar to those in the above-described embodiments are represented by the same reference numerals or symbols, or represented by the same member names, even when the reference numerals or symbols are different, and will be omitted from this description.

In this embodiment, between a forward path and a backward path of the U-shaped fold-back air passageway 28, an air passageway 35 independent of the fold-back air passageway 28 is provided.

The U-shaped fold-back air passageway 28 in this embodiment includes a forward path 28*a* before the air passageway 28 is folded back below the fixing device 14 (fixing portion). The U-shaped fold-back air passageway 28 further includes a backward path 28*b* after the air passageway 28 is folded back below the fixing device 14 (fixing portion). Further, the air passageway 35, different from and independent of, the U-shaped fold-back air passageway 28 is provided between the forward path 28*a* and the backward path 28*b*.

The duct 24*c* shown in part (a) of FIG. 7 includes a bottom plate 29*a* provided along a discharge direction (leftward direction in FIG. 1) of the recording material S. The duct 24*c* further includes a pair of side plates 29*a* and 29*b*, which are perpendicular to the bottom plate 29*d* and which stand from the bottom plate 29*d*. The duct 24*c* further includes a pair of partition walls 29*e* and 29*f*, which are perpendicular to the bottom plate 29*d* and which stand from the bottom plate 29 between the pair of side plates 29*a* and 29*b*. The duct 24*c* is constituted so that a height thereof gradually lowers toward the fixing device 14.

The image forming apparatus 100 in this embodiment includes a suction fan 25*c*. When the suction fans 25*a* and 25*c* are rotated, the air passageways 28 and 35 through which the air 27 taken from the outside of the main assembly of the image forming apparatus 100 into the inside of the main assembly of the image forming apparatus 100 passes.

The air passageway 35 provided independently of the U-shaped fold-back air passageway 28 is constituted in an I-shape, as shown in FIG. 9, and in an L-shape in cross section, as shown in FIG. 8.

As shown in FIG. 9, the air passageway 35 is provided between the forward path 28*a* and the backward path 28*b* of the U-shaped fold-back air passageway 28.

The air 28 passing through the air passageway 35 passes between the intermediary transfer unit 13 and the discharge tray 20.

Thereafter, the air 27 passes between the fixing device 14 and a wall 20*b* standing from the bottom plate 20*a* of the discharge tray 20. Thereafter, the air 27 blows to the outside of the main assembly of the image forming apparatus 100 through an opening 36. At this time, as shown in FIG. 8, the air 28 blowing through the opening 36 blows against a surface, on which the toner image is formed, of a recording material S2 to be discharged onto the discharge tray 20.

As a result, the image-formed surface of the recording material S2, in which residual heat remains, is cooled by the air 27 blowing through the opening 36, so that sticking between the recording materials S when the recording materials S are stacked on the discharge tray 20 can be prevented. Further, between the forward path 28*a* and the backward path 28*b* of the U-shaped fold-back air passageway 28, the air passageway 35, dependent of the U-shaped fold-back air passageway 28, is provided. As a result, curvature at a fold-back portion 28*c* of the air passageway 28 becomes small (i.e., a radius of the curvature becomes large). For this reason, pressure loss in the air passageway 28 can be reduced, so that the air 27 can be caused to efficiently pass through the air passageway 28.

Fourth Embodiment

A constitution of a Fourth Embodiment of the image forming apparatus according to the present invention will be described with reference to FIG. 10. FIG. 10 is a perspective view showing a flow of the air 27 passing through a duct 24*d* in the Second Embodiment. Incidentally, constituent elements similar to those in the above-described embodiments are represented by the same reference numerals or symbols, or represented by the same member names, even when the reference numerals or symbols are different, and will be omitted from this description.

In this embodiment, an air suction surface 32*d* is common to the U-shaped fold-back air passageway 28 and the air passageway 35 dependent of the U-shaped fold-back air passageway 28, and a single suction fan 25*a* is provided in the neighborhood of the air suction surface 32*d*.

In this embodiment, the air heat-insulating layer is formed between the image forming portion 30 constituted by the process cartridges 7 and the intermediary transfer unit 13, and the discharge portion 31 constituted by the fixing device 14 and the discharge tray 20. The air heat-insulating layer is formed by the U-shaped fold-back air passageway 28. As regards the fold-back air passageway 28, between the forward path 28*a* before the air passageway 28 is folded back below the fixing device 14 and the backward path 28*b* after the air passageway 28 is folded back below the fixing device 14, the air passageway 35 different from the fold-back air passageway 28 is formed. Further, the taking-in of the air 27 to the fold-back air passageway 28 and the air passageway 35 is carried out by the single suction fan 25*c*.

As a result, compared with the constitution in which the suction fans 25*a* and 25*c* are provided independently for the air passageways 28 and 35, respectively, as in the Third Embodiment described above, cost reduction can be realized. Other constituent elements are similar to those in the above-described embodiments, so that similar effects can be obtained.

Incidentally, the present invention is not necessarily limited to only the above-described embodiments, but can also be carried out in various constitutions for suppressing temperature rise of the image forming process portion and the transfer portion. For example, the air 27 passed through the passing air passageway 35 is guided to a periphery of electrical parts, such as a motor and a power (voltage) source, which are provided inside the main assembly of the image forming apparatus 100. Thus, the air 27 passed through the air passageway 35 may also be used for cooling the electrical parts.

Another Embodiment

In the above-described embodiments, an example of the image forming apparatus 100, in which the intermediary transfer unit 13 as the transfer portion for transferring the toner images from the photosensitive drums 1 (image bearing members) onto the recording material S was provided, was described. In addition, the present invention is also applicable to an image forming apparatus in which the intermediary transfer unit 13 (transfer portion) is not provided, although such an image forming apparatus is not illustrated.

While the present invention has been described with reference to exemplary embodiments, it is to be understood that the invention is not limited to the disclosed exemplary embodiments. The scope of the following claims is to be accorded the broadest interpretation so as to encompass all such modifications, and equivalent structures and functions.

What is claimed is:

1. An image forming apparatus comprising:

an image forming portion configured to form a toner image on a recording material;

a fixing portion configured to fix the toner image on the recording material;

a stacking portion configured to stack the recording material, on which the toner image is fixed;

an air passageway provided between said image forming portion and said fixing portion and between said image forming portion and said stacking portion; and an air blowing portion configured to blow air to said air passageway from outside of said image forming apparatus, wherein said air passageway is configured so that the air blown by said air blowing portion passes below said stacking portion in a first direction toward said fixing portion and, thereafter, is folded back below said fixing portion and, then, passes again below said stacking portion in a second direction, opposite to the first direction.

2. The image forming apparatus according to claim 1, wherein said air passageway includes an air suction surface through which the air is sucked from outside of said image forming apparatus by said air blowing portion, and an air discharge surface through which the air passing through said air passageway is discharged to the outside of said image forming apparatus, said air suction surface and said air discharge surface being provided on the same flat plane.

3. The image forming apparatus according to claim 2, wherein an inlet of a power source is provided on the flat plane.

4. The image forming apparatus according to claim 1, wherein said air passageway includes a forward path, through which the air flows before the air is folded back below said fixing portion, and a backward path, through which the air flows after the air is folded back below said fixing portion, and, between said forward path and said backward path, another air passageway, different from said air passageway, is formed.

5. The image forming apparatus according to claim 4, wherein the other air passageway is an air passageway configured to blow the air to the recording material discharged from said image forming apparatus.

6. An image forming apparatus comprising:

an image forming portion configured to form a toner image on a recording material;

a fixing portion configured to fix the toner image on the recording material;

a stacking portion configured to stack the recording material, on which the toner image is fixed;

a first air passageway provided between said image forming portion and said fixing portion and between said image forming portion and said stacking portion;

a second air passageway provided between said image forming portion and said stacking portion;

a first fan configured to blow air to said first air passageway from outside of the image forming apparatus; and a second fan configured to blow air to said second air passageway from outside of the image forming apparatus, wherein said first air passageway is configured so that the air blown by said first fan passes below said stacking portion and, thereafter, is folded back below said fixing portion and, then, passes again below said stacking portion, and wherein said second air passageway is configured so that the air blown by said second fan passes below said stacking portion and, thereafter, is bent and passes between said stacking portion and said fixing portion and, then, hits the recording material discharged from said fixing portion.

7. The image forming apparatus according to claim 6, wherein said first air passageway includes an air suction surface, through which the air is sucked from outside of said image forming apparatus by said first fan, and an air discharge surface, through which the air passing through said first air passageway is discharged to the outside of said image forming apparatus, said air suction surface and said air discharge surface being provided on the same flat plane.

8. The image forming apparatus according to claim 7, wherein an inlet of a power source is provided on the flat plane.

9. The image forming apparatus according to claim 6, wherein said first air passageway includes a forward path, through which the air flows before the air is folded back below said fixing portion, and a backward path, through which the air flows after the air is folded back below said fixing portion, and said second air passageway is formed between said forward path and said backward path.

10. The image forming apparatus according to claim 9, wherein said second air passageway is configured to blow the air to the recording material discharged from said image forming apparatus.

* * * * *